US009934931B2

(12) United States Patent
Bathe et al.

(10) Patent No.: US 9,934,931 B2
(45) Date of Patent: Apr. 3, 2018

(54) ROTATING ANODE MOUNT ADAPTIVE TO THERMAL EXPANSION

(71) Applicant: KONINKLIJKE PHILIPS N.V., Eindhoven (NL)

(72) Inventors: Christoph Helmut Bathe, Hamburg (DE); Ulrich Hermann Hove, Hamburg (DE)

(73) Assignee: KONINKLIKE PHILIPS N.V., Eindhoven (NL)

( * ) Notice: Subject to any disclaimer, the term of this patent is extended or adjusted under 35 U.S.C. 154(b) by 250 days.

(21) Appl. No.: 14/903,805

(22) PCT Filed: Jun. 20, 2014

(86) PCT No.: PCT/EP2014/063013

§ 371 (c)(1),
(2) Date: Jan. 8, 2016

(87) PCT Pub. No.: WO2015/003886

PCT Pub. Date: Jan. 15, 2015

(65) Prior Publication Data

US 2016/0163498 A1 Jun. 9, 2016

(30) Foreign Application Priority Data

Jul. 11, 2013 (EP) ..... 13176026

(51) Int. Cl.
*H01J 35/00* (2006.01)
*H01J 35/10* (2006.01)
*H01J 9/14* (2006.01)

(52) U.S. Cl.
CPC ..... *H01J 35/101* (2013.01); *H01J 9/148* (2013.01); *H01J 2235/1006* (2013.01); *H01J 2235/1013* (2013.01); *H01J 2235/1046* (2013.01)

(58) Field of Classification Search
CPC ..... H01J 2235/1006; H01J 2235/1013
See application file for complete search history.

(56) References Cited

U.S. PATENT DOCUMENTS 4,635,283 A 1/1987 Starek
6,888,923 B2 5/2005 Dahan
(Continued)

FOREIGN PATENT DOCUMENTS

JP S553181 A 1/1980
JP 61198537 A 9/1986
(Continued)

*Primary Examiner* — Dani Fox
(74) *Attorney, Agent, or Firm* — Larry Liberchuk

(57) ABSTRACT

The present invention relates to mounting of an anode disk. In order to provide a mount of an anode disk to a rotating shaft that is suitable for increased thermal loads on the anode disk, a rotating anode assembly (10) is provided that comprises an anode disk (12), a rotating shaft (14), and an anode disk support (16). The anode disk is concentrically mounted to a rotating axis (18) of the rotating shaft via the anode disk support, and the anode disk support comprises a first support (20) with a first circular axial support surface (22) that is provided at the rotating shaft in a concentric manner with the rotating axis. Further, the anode disk support comprises a second support (24) with a second axial support surface (26) that is at least temporarily attached to the rotating shaft for urging the anode disk against the first support surface in an axial clamping direction. Still further, the first support is provided as a radially flexible support (28). Upon heating up of the anode disk during X-ray generation, and a thermal expansion of the anode disk, the radially flexible support bends (32) radially such that the first axial support surface at least partly follows the thermal expansion in a radial direction.

14 Claims, 5 Drawing Sheets

(56) References Cited

U.S. PATENT DOCUMENTS

| | | | |
|---|---|---|---|
| 7,164,751 | B2 | 1/2007 | Weil |
| 2004/0234033 | A1 | 11/2004 | Anno |
| 2011/0228905 | A1 | 9/2011 | Behling |
| 2012/0134467 | A1 | 5/2012 | Whittum |

FOREIGN PATENT DOCUMENTS

| | | | |
|---|---|---|---|
| JP | 6045245 | U | 6/1994 |
| JP | 2011238549 | A | 11/2011 |

ROTATING ANODE MOUNT ADAPTIVE TO THERMAL EXPANSION

CROSS-REFERENCE TO PRIOR APPLICATIONS

This application is the U.S. National Phase application under 35 U.S.C. § 371 of International Application No. PCT/EP2014/063013, filed on Jun. 20, 2014, which claims the benefit of European Patent Application No. 13176026.6, filed on Jul. 11, 2013. These applications are hereby incorporated by reference herein.

FIELD OF THE INVENTION

The present invention relates to mounting of an anode disk, and relates in particular to a rotating anode assembly, to an X-ray tube, to an X-ray imaging system, to a method for mounting a rotating anode disk, and to a use of a support in an X-ray tube for mounting an anode disk to a rotating shaft.

BACKGROUND OF THE INVENTION

For the generation of X-ray radiation, rotating anode disks are provided. During the X-ray generation, heat is generated by the electrons impinging on the anode disk's surface for generating the X-ray radiation. Even in case of cooling arrangements for getting rid of the generated heat, the anode disk becomes very hot, for example in an X-ray tube used for a CT imaging system. U.S. Pat. No. 7,164,751 B2 describes an anode disk with a chamber between the anode disk and the mounting counterpart filled with a heat transferring material. The material is deformable to follow deformations of the surfaces caused by the generated heat. When the anode disk heats up, thermal expansion occurs, which affects the mechanical mount of the anode disk to a rotating shaft. It has been shown that thermal expansion results in parts of the anode disk may experience deformation in radial direction due to the thermal gradients and different expansion coefficient of the used materials. In case of an anode disk mounted to the rotating shaft by a clamping force caused by a nut, an off-centre positioning of the anode disk may occur during operation. However, this results in an imbalance, and together with the rotation velocity, this may cause unwanted vibration and noise. Since an increasing demand for higher output of X-ray generation exists, thermal expansion related issues of the mounting of the anode disk also increase.

SUMMARY OF THE INVENTION

There may be a need to provide a mount of an anode disk to a rotating shaft that is suitable for increased thermal loads on the anode disk.

The object of the present invention is solved by the subject-matter of the independent claims, wherein further embodiments are incorporated in the dependent claims. It should be noted that the following described aspects of the invention apply also for the rotating anode assembly, the X-ray tube, the X-ray imaging system, and the method for mounting a rotating anode disk, as well as for the use of a support in an X-ray tube for mounting an anode disk to a rotating shaft.

According to the present invention, a rotating anode assembly is provided that comprises an anode disk, a rotating shaft, and an anode disk support. The anode disk is concentrically mounted to a rotating axis of the rotating shaft via the anode disk support. The anode disk support comprises a first support with a first circular axial support surface that is provided at the rotating shaft in a concentric manner with the rotating axis. The anode disk support comprises a second support with a second axial support surface that is at least temporarily attached to the rotating shaft for urging the anode disk against the first support surface in an axial clamping direction. The first support is provided as a radially flexible support. Further, upon heating up of the anode disk during X-ray generation, and a thermal expansion of the anode disk, the radially flexible support bends radially such that the first axial support surface at least partly follows the thermal expansion in a radial direction.

As an advantage, the anode disk is securely supported even though a certain deformation caused by thermal expansion may occur. By providing a flexible support that bends so-to-speak following the thermal expansion, the contact portions where the clamping of the anode disk occurs, remain stable. In other words, friction between two contacting surfaces of the anode attached to the rotating shaft is avoided, or at least reduced to a minimum.

According to an example, the first support has a larger resistance to forces in the axial direction than in the radial direction.

For example, this can be achieved by different geometric relations and proportions as described below, or with different metarial characteristics.

According to an example, the first support surface is provided on a rotating shaft. The first axial support surface compensates for thermal expansion of the anode disk such that, during the thermal expansion, a first contact area of the first support surface and a second contact area of the anode disk commonly move in relation to the rotating axis such that the contact is maintained.

According to an example, the first support is connected to the rotating shaft by a support base, wherein the support base is provided with a base height in the axial direction, wherein the base height is larger than the radial width of the first support.

According to an example, the shoulder is formed by a stepwise recess of the outer diameter of the rotating shaft.

For example, the recess is forming a sort of end face of the part of the diameter of the shaft that has a larger diameter.

In another example, the shoulder is provided by a cantilevering circumferational protrusion, extending beyond the outer diameter of the adjacent shaft surface.

According to an example, the first support comprises an axial circular collar protruding from a shoulder on the rotating shaft in an axial direction with a clearance groove between the collar and the rotating shaft.

According to an example, the first support comprises a plurality of radially flexible support elements that provide a plurality of first axial support surface portions.

According to an example, a heat transfer element is provided between the radially flexible support and the rotating shaft for heat conduction via the rotating shaft.

As an advantage, considering the reduced cross-section of the possible paths for dissipating heat, due to the reduced contact surface of the anode support, the heat transfer element provides a further thermal pathway, while not influencing any supporting forces and other aspects of the support.

In an example, the bending of the radially flexible support is restricted to an elastic deformation.

According to a further example, also the second support is provided with a second circular axial support surface. The second support is also provided as a radially flexible support.

Upon heating up of the anode disk during X-ray generation, and a thermal expansion of the anode disk, the radially flexible support of the second support bends radially such that the second axial support surface at least partly follows the thermal expansion in a radial direction.

According to the present invention, also an X-ray tube is provided that comprises an X-ray vacuum housing, an anode, a cathode, and a bearing arrangement for supporting the anode. The anode and the cathode are arranged inside the X-ray vacuum housing. The anode is provided as a rotating anode assembly according to one of the above-mentioned examples. The bearing arrangement is arranged inside the X-ray vacuum housing supporting the rotating shaft. The bearing arrangement comprises at least one spiral groove bearing.

As an advantage, due to the rotating anode assembly being adaptive to thermal expansion, an improved fixation of the anode disk is provided, meaning an improved positioning of the center of the anode disk aligned with the rotation axis. This is in particular suitable in combination with spiral groove bearings that go along with an increased demand for accuracy in terms of imbalance causing vibrations.

According to an example, the rotating shaft is provided hollow with a bore and a fixed shaft is provided inside the bore, supporting the rotating shaft. The rotating shaft is supported by the fixed shaft with a spiral groove bearing arrangement.

According to the present invention, also an X-ray imaging system is provided, comprising an X-ray acquisition device with an X-ray source and an X-ray detector, as well as an object support. The object support is arranged between the X-ray source and the X-ray detector for radiating the object with X-rays provided by the X-ray source. The X-ray source comprises an X-ray tube according to the above-mentioned examples.

According to the present invention, also a method for mounting a rotating anode disk is provided, comprising the following steps:

a) providing a first support of an anode disk support at a rotating shaft perpendicular to a rotating axis of the shaft, wherein the first support comprises a first axial support surface that is provided at the rotating shaft in a concentric manner around the rotating axis;
b) providing an anode disk;
c) providing a second support of the anode disk support, wherein the second support comprises a second axial support surface; and
d) at least temporarily attaching the second support to the rotating shaft for urging the anode disk against the first support in an axial clamping direction. The first support is provided as a radially flexible support. Upon heating up of the anode disk during X-ray generation, the radially flexible support bends radially such that the first axial support surface at least partly follows a thermal expansion of the anode disk in a radial direction. According to the present invention, also a use of a support in an X-ray tube for mounting an anode disk to a rotating shaft is provided. The support comprises a first support with a first axial support surface that is provided at a rotating shaft in a concentric manner around a rotating axis. A second support with a second axial support surface is provided. The second support is at least temporarily attached to the rotating shaft for urging an anode disk against the first support in an axial clamping direction. The first support is provided as a radially flexible support. Upon heating up of the anode disk during X-ray generation, the radially flexible support bends radially such that the first axial support surface at least partly follows a thermal expansion of the anode disk in a radial direction.

According to an aspect of the present invention, a rotating disk is mounted to a rotating shaft in a way that at least on one side of the anode disk, when the disk is clamped in the mounted state, the contacting surfaces remain stable to each other such that no friction occurs and no imbalance is caused. The adaption for considering the thermal expansion, i.e. the so-to-speak movement (even though very small) of the support surface portions on the rotating shaft are provided on flexible support elements. Thus, instead of allowing thermal expansion resulting in frictional movement with rigid support elements, amending of the support itself is provided for adapting the support to the thermal expansion that occurs during X-ray generation to different degrees, depending on the respective situation. Thus, a fixed and centric mount of the anode disk is provided, while still allowing the concentric thermal expansion of the anode disk.

These and other aspects of the present invention will become apparent from and be elucidated with reference to the embodiments described hereinafter.

BRIEF DESCRIPTION OF THE DRAWINGS

Exemplary embodiments of the invention will be described in the following with reference to the following drawings.

DETAILED DESCRIPTION OF EMBODIMENTS

Figure 1A:
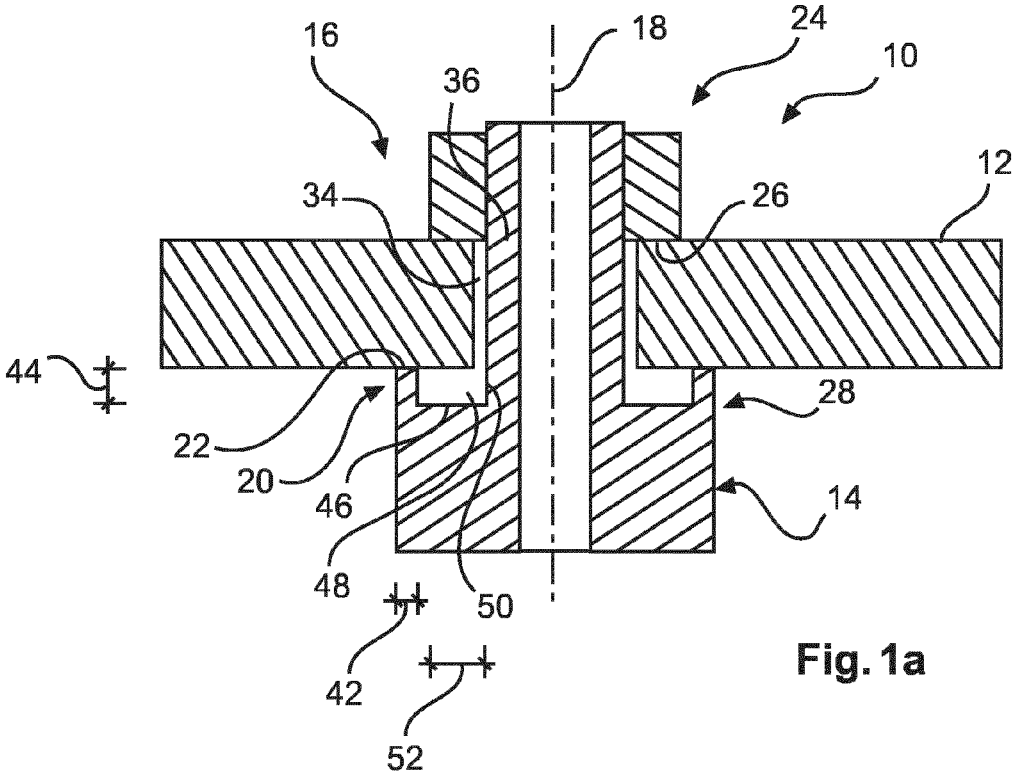
FIG. 1 shows a schematic cross-section of an example of a rotating anode assembly in a first state in FIG. 1A, and in a second state indicating thermal expansion of the anode disk in FIG. 1B.

FIG. 1A shows a rotating anode assembly 10, comprising an anode disk 12, a rotating shaft 14, and an anode disk support 16. Further, a rotational axis 18 of the rotating shaft 14 is indicated. The anode disk 12 is concentrically mounted to the rotational axis 18 of the rotating shaft 14 via the anode disk support 16. The anode disk support 16 comprises a support 20 with a first circular axial support surface 22 that is provided at the rotating shaft 14 in a concentric manner with the rotating axis 18. The first support 20 and the first circular axial support surface 22 are further described below. The anode disk support 16 also comprises a second support 24 with a second axial support surface 26 that is at least temporarily attached to the rotating shaft 14 for urging the anode disk 12 against the first support surface 22 in an axial clamping direction. The first support 20 is provided as a radially flexible support 28, as also shown in FIG. 1B.

Figure 1B:
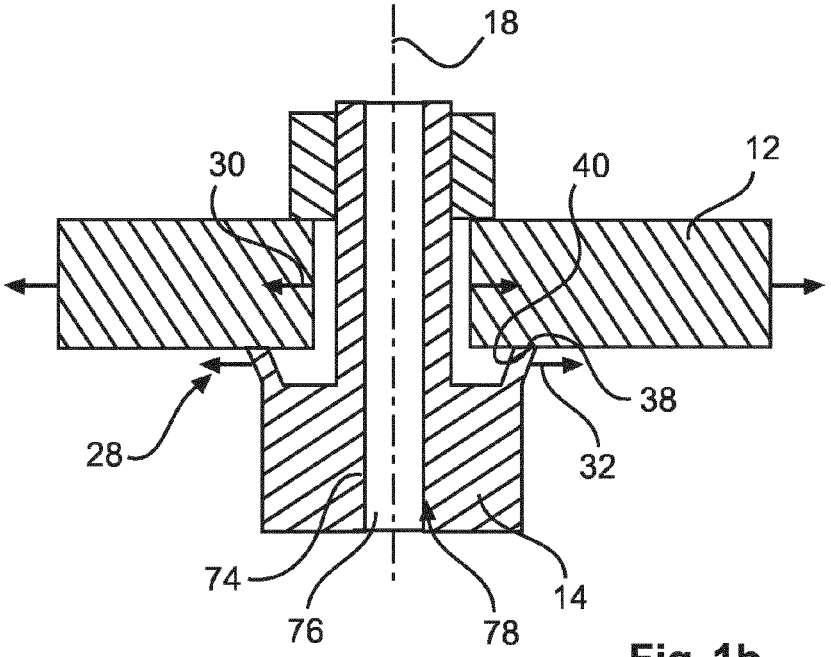

FIG. 1B shows a state where the anode disk 12 is heated up, for example caused by X-ray generation, and a thermal expansion of the anode disk has taken place, as indicated with thermal expansion arrows 30. The radially flexible support 28 bends, as indicated with bending arrows 32. The bending takes place radially such that the first axial support surface 22 at least partly follows the thermal expansion in a radial direction, i.e. perpendicular to the rotational axis 18.

The "anode disk" relates to an anode that has a circular form with a flat shape in the radial direction. The anode disk is mounted to the rotating shaft such that the radial direction of the disk is perpendicular to the rotating axis of the shaft.

The "first circular axial support surface" relates to an abutment surface for the mounting of the anode disk, wherein the abutment takes place in an axial direction, i.e. in a direction of the rotating axis. The "second axial support surface" relates to an abutment surface for the mounting of the anode disk, wherein the abutment takes place in an axial direction, i.e. in a direction of the rotating axis. The first axial support surface and the second axial support surface are arranged on opposite sides of the anode disk, clamping the rotating disk between. In other words, the first and second axial support surfaces are abutting the rotating disk from two different sides.

The first circular support surface is also referred to as first interface, and the second circular support surface as second interface.

In an example, the anode disk is provided with a central bore 34. In an example, the second support is a nut threaded onto an end 36 of the shaft extending through the central bore 34.

In an example, the second support 24 is a bushing.

In a further example, the second support is provided by a clamping element that is welded or brazed to the end of the rotating shaft 14.

In an example, the first support surface is integrally formed on the rotating shaft, i.e. as a single workpiece or component.

It must be noted that the bending movement illustrated in FIG. 1B is shown in a rather extreme manner for illustrational purposes only. In reality, according to the present invention, the deformation is in a range of, for example, up to 0.5 mm, e.g. up to 0.3 mm or 0.2 mm.

The bending of the radially flexible support is restricted to an elastic deformation.

The first support surface 22 is shown in FIG. 1A and FIG. 1B provided on the rotating shaft 14. The first axial support surface 22 compensates for thermal expansion of the anode disk 12 such that, during the thermal expansion, a first contact area 38 of the first support surface and a second contact area 40 of the anode disk 12 commonly move in relation to the rotating shaft 14, and also in relation to the rotating axis 18, such that the contact is maintained. In other words, the contact is maintained and a frictional relative movement between the first and the second contact area is prevented, or at least reduced to a minimum.

According to an example, also shown in FIG. 1A, in an axial cross-section, the first support 20 is provided with a radial width 42 and an axial height 44, wherein the radial width 42 is smaller than the axial height 44. For example, the axial height 44 is at least the double amount of the radial width 42.

According to another example, also shown in FIG. 1A as an option, the first support is connected to the rotating shaft by a support base 43, wherein the support base 43 is provided with a base height 51 in the axial direction. The base height 51, which is the distance from the horizontal reference line X, is larger than the radial width 42 of the first support. For example, the base height 51 is at least the double amount of the radial width 42. The connection between the support base and the rotating shaft along the reference line X can be continuous or separated.

According to another example, also shown in FIGS. 1A, 1B and 1C as an option, the first support 20 is provided protruding in an axial direction from a shoulder 46 on the rotating shaft, wherein, as an option, the shoulder is formed by a stepwise recess of the outer diameter of the rotating shaft.

At least a circumferential gap 48 to a shaft-end 50 extending through the bore of the anode disk 12 is provided.

For example, also shown as an option in FIGS. 1A and 1B, the first support 20 is provided with a distance 52 to the shaft-end 50 extending through the bore of the anode disk 12, wherein the distance 52 is larger than the axial height 44.

For example, the distance is at least the double amount of the axial height 44.

Figure 2A:
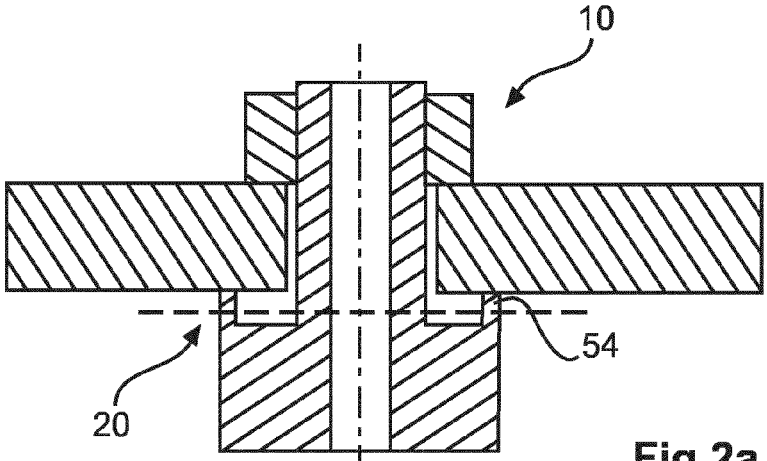
FIG. 2 shows a further example of a rotating anode assembly in a cross-section along a rotational axis in FIG. 2A, and in a cross-section transverse to the rotational axis in FIG. 2B, showing a radially flexible support.
Figure 2B:
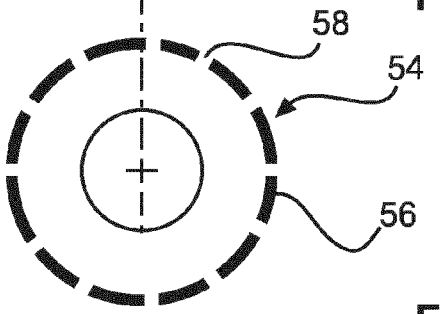

FIG. 2A shows a further example of the rotating anode assembly 10, where the first support 20 comprises a plurality of radially flexible support elements 54, which are shown in a horizontal cross-section in FIG. 2B. The radially flexible support elements provide a plurality of first axial support surface portions 56. In an example, as indicated, the radially flexible support elements 54 are provided with a gap 58 to each other. In a further example, not shown, the gap is reduced to a minimum such that the adjacent support elements are abutting each other on the side faces in the non-bended state.

In an example, the radially flexible support elements 54 are provided in a castellated manner, which is also referred to as battlement design.

As an example, the radially flexible support elements are provided as thermally dependent radially flexible support elements.

The support elements are provided with a flexibility that is sufficient enough to allow a bending caused by the thermal expansion of the anode via friction force between the first circular axial support surface and the counterpart on the anode disk surface. The friction force is caused by a nut's clamping force. The support elements are rigid enough to allow a proper mounting.

In an example, the flexibility is at least twice as large as the friction force, e.g. five times the friction force.

According to an example, the radially flexible support elements, which are also referred to as pinnacles, are dimensioned such that the friction force at the contact area is sufficient enough to cause an elastic bending of the pinnacles.

In an example, 12 slits are provided resulting in approximately 30° circular segments:

The support surface is 2.5 mm in width (h).

The depth of the groove is 6 mm (l).

And the slits have a width of 4 mm, resulting in b=15 mm.

The radial displacement of the support surface is:

$$f=F\cdot l^3/3\cdot E\cdot I$$

The geometrical moment of inertia is approximately $I=b\cdot h^3/12$

The required friction force, with the given radial displacement is:

$F=(b\cdot h^3\cdot E/4\cdot l^3)\cdot f$

As a first approach, the maximum radial displacement is: f=0.03 mm

As a result, the requested friction force is: F=2.4 kN

Assuming a minimum friction coefficient of μ=0.2, the requested pressing force is: $F_n$=12 kN This force is provided by tightening the nut, for example.

Figure 3A:
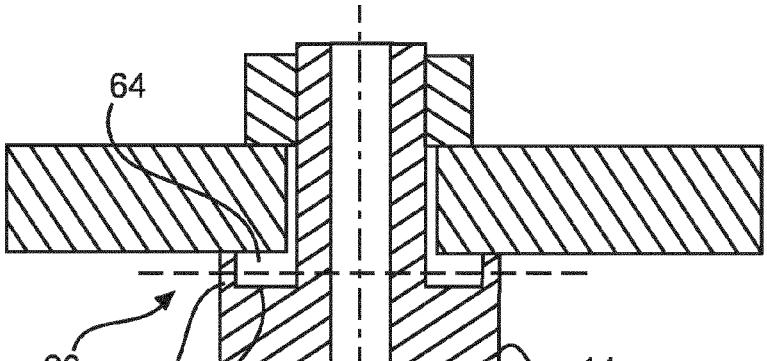
FIG. 3 shows a further example of a rotating anode assembly in a cross-section along the rotational axis in FIG. 3A and in a cross-section transverse to the rotational axis in FIG. 3B.
Figure 3B:
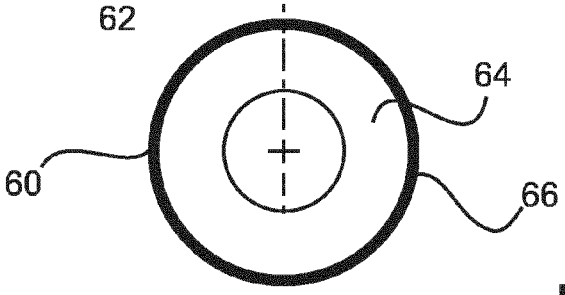

FIG. 3A shows a further example of the first support 20 provided comprising an axial circular collar 60 protruding from a shoulder portion 62 on the rotating shaft 14 in an axial direction with a clearance groove 64 between the collar 60 and the rotating shaft 14. For example, the shoulder 62 is provided by a recess of the diameter of the shaft in the radial direction. In an example, the recess is provided as a step in the diameter of the rotational axis. The collar 60 is shown in FIG. 3B in a horizontal cross-section or top view, wherein the collar 60 provides a circular support surface 66. It is noted that the collar 60 is shown in a similar dimension as the flexible support elements 54 for the sake of simplicity. In an example, the collar is provided with a thinner dimension for allowing a similar bending movement as the plurality of the flexible support elements 54.

In a further example, not further shown, a different number of segments, for example three segments of the collar of FIG. 3B, are provided.

Figure 4:
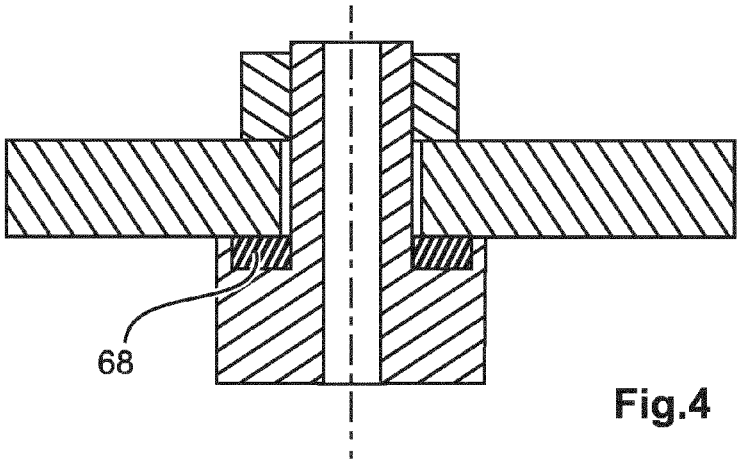
FIG. 4 shows a further example of a rotating anode assembly with a heat transfer element provided between the rotating shaft and the anode disk.

In a further example, shown in FIG. 4, a heat transfer element 68 is provided between the radially flexible support and the rotating shaft for heat conduction via the rotating shaft. In an example, the heat transfer element comprises a heat conduction liquid, for example in a flexible envelope in case of flexible support elements. In case of a continuous collar, the liquid may be provided without an envelope.

Figure 5A:
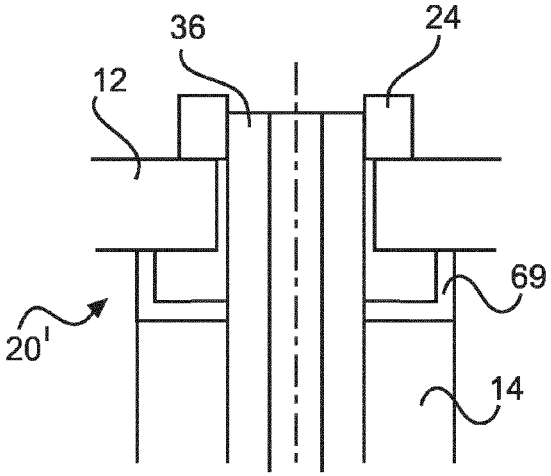
FIG. 5A shows a further example of a rotating anode assembly with a further example of a radially flexible support.

FIG. 5A shows a further example where the first support 20 is provided as a separate component, for example as a disk 20' having an L-shaped cross-section 69 on either side of the middle portion, having a bore through which the extending part of the rotating shaft extends. The separate component is fixedly attached to the rotating shaft, for example by an accurately fitting bore enclosing the rotating shaft. In other words, the first support is provided as a bushing with a U-shaped cross-section providing a collar that provides the first circular axial support surface. In case of a separate component, care must be taken that a base-point of the axial support surface is fixedly provided in radial direction to the rotational axis.

Figure 5B:
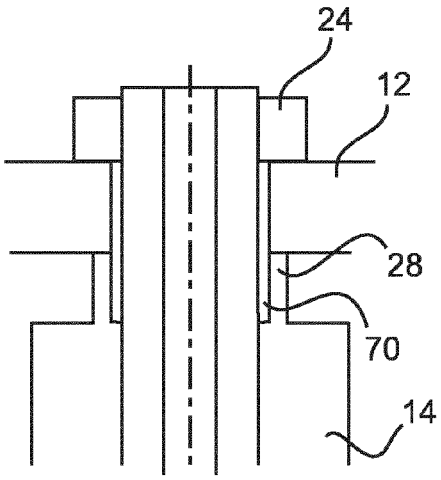
FIG. 5B shows a further example of a radially flexible support.

FIG. 5B shows a further example, where the radially flexible support 28 is provided with a small gap 70 to the adjacent part of the rotating shaft 14.

Figure 5C:
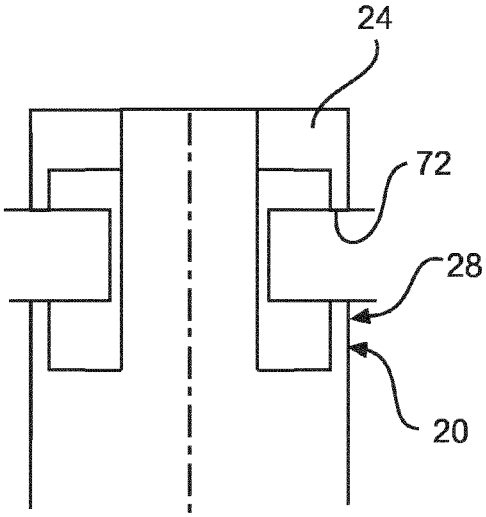
FIG. 5C shows a further example with a radially flexible support on opposing sides of the anode disk.

FIG. 5C shows a further example, where, in addition to the radially flexible support 28 of the first support 20, also the second support 24 is provided with a second circular axial support surface 72, provided as a radially flexible support. Upon heating up of the anode disk during X-ray generation, and a thermal expansion of the anode disk 12, the radially flexible support of the first support 20 as well as the radially flexible support of the second support 24 bends radially such (not further shown) that the first axial support surface and the second axial support surface at least partly follow the thermal expansion in a radial direction.

Figure 6:
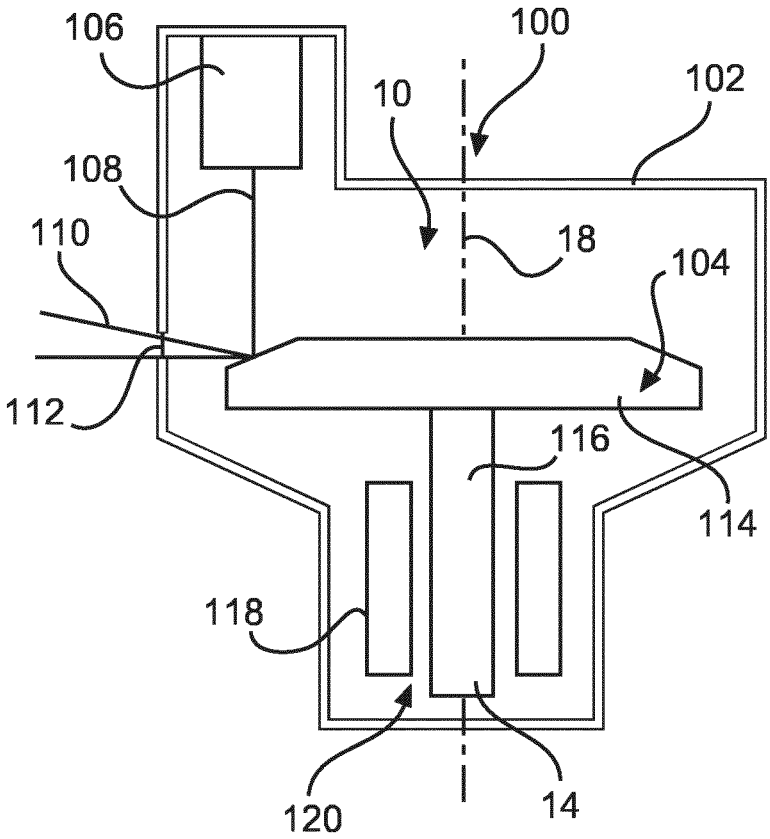
FIG. 6 shows a schematic cross-section of an X-ray tube.

FIG. 6 shows an X-ray tube 100 comprising an X-ray vacuum housing 102, an anode 104, and a cathode 106. An electron beam 108 is schematically shown, generating X-ray radiation 110 emanating through an X-ray transparent window 112 in the X-ray vacuum housing 102. The anode 104 and the cathode 106 are arranged inside the X-ray vacuum housing 102. The anode 104 is shown with an anode disk 114 mounted to an anode shaft 116. Further, a driving mechanism 118 is shown schematically for driving the rotating anode 114 rotating around the rotation axis 18. Further components are provided, but not shown. Still further, not shown in detail, a bearing arrangement for supporting the anode is provided, the bearing arrangement indicated with reference numeral 120.

According to the present invention, the anode 104 is provided as a rotating anode assembly 10 according to one of the above-mentioned examples. The bearing arrangement 120 is arranged inside the X-ray vacuum housing 102 supporting the rotating shaft 14, 116. The bearing arrangement comprises at least one spiral groove bearing, not further shown.

According to an example, indicated in FIGS. 1 to 5, the rotating shaft 14 is provided hollow with a bore 74, and a fixed shaft 76 is provided inside the bore 74 supporting with a spiral groove bearing arrangement 78.

Figure 7:
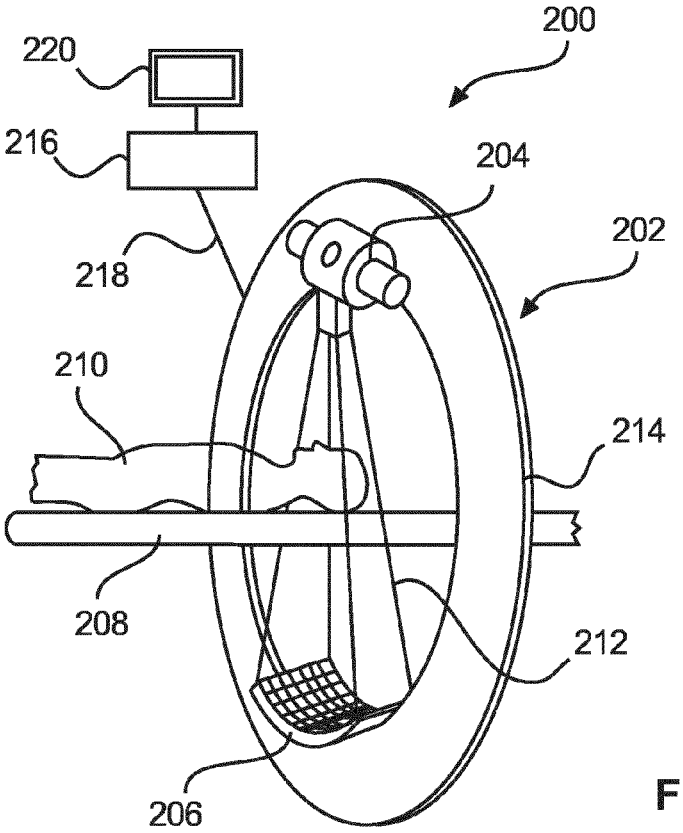
FIG. 7 shows an example of an X-ray imaging system in form of a CT system.

FIG. 7 shows an example of an X-ray imaging system 200, comprising an X-ray acquisition device 202 with an X-ray source 204 and an X-ray detector 206. Further, an object support 208 is provided. The object support 208 is arranged between the X-ray source 204 and the X-ray detector 206 for radiating the object, for example a patient 210, with X-rays, indicated with fan-shaped structure 212, provided by the X-ray source 204. The X-ray source 204 comprises an X-ray tube 100 according to the above-mentioned examples.

It is noted that the X-ray imaging system 200 is shown as a CT arrangement with a gantry 214 schematically indicated. Further, a processing unit 216 is data-connected 218, also in combination with a display unit 220.

Instead of a CT arrangement, also other X-ray imaging systems are provided, for example a C-arm system or X-ray imaging systems with fixed arrangement of the X-ray source in relation to the object support.

Figure 8:
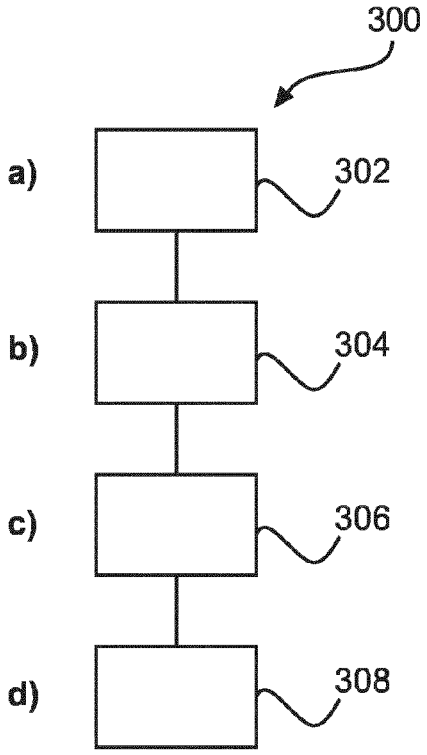
FIG. 8 shows basic steps of an example of a method for mounting a rotating anode disk.

FIG. 8 shows a method 300 for mounting a rotating anode disk, comprising the following steps:

- In a first step 302, a first support of an anode disk support at a rotating shaft is provided perpendicular to a rotating axis of the shaft. The first support comprises a first axial support surface that is provided at the rotating shaft in a concentric manner around the rotating axis.
- In a second step 304, an anode disk is provided.
- In a third step 306, a second support of the anode disk support is provided, wherein the second support comprises a second axial support surface.
- In a fourth step 308, the second support is at least temporarily attached to the rotating shaft for urging the anode disk against the first support in an axial clamping direction. The first support is provided as a radially flexible support, and, upon heating up of the anode disk during X-ray generation, the radially flexible support bends radially such that the first axial support surface at least partly follows a thermal expansion of the anode disk in a radial direction.

The first step 302 is also referred to as step a), the second step 304 as step b), the third step 306 as step c), and the fourth step 308 as step d).

According to a further example, not further shown, also a use of a support in an X-ray tube for mounting an anode disk to a rotating shaft is provided.

It has to be noted that embodiments of the invention are described with reference to different subject matters. In particular, some embodiments are described with reference to method type claims whereas other embodiments are described with reference to the device type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

In the claims, the word "comprising" does not exclude other elements or steps, and the indefinite article "a" or "an" does not exclude a plurality. A single processor or other unit may fulfill the functions of several items re-cited in the claims. The mere fact that certain measures are re-cited in mutually different dependent claims does not indicate that a combination of these measures cannot be used to advantage. Any reference signs in the claims should not be construed as limiting the scope.

The invention claimed is:

1. A rotating anode assembly, comprising:

an anode disk having a bore;

a rotating shaft; and an anode disk support;

wherein the anode disk is concentrically mounted to a rotating axis of the rotating shaft via the anode disk support;

wherein the anode disk support comprises a first support with a first circular axial support surface that is provided at the rotating shaft in a concentric manner with the rotating axis; and wherein the anode disk support comprises a second support with a second axial support surface that is at least temporarily attached to the rotating shaft for urging the anode disk against the first support surface in an axial clamping direction;

wherein the first support is provided as a radially flexible support;

wherein, upon heating up of the anode disk during X-ray generation, and a thermal expansion of the anode disk, the radially flexible support bends radially such that the first axial support surface at least partly follows the thermal expansion in a radial direction;

wherein the first support has a larger resistance to forces in the axial direction than in the radial direction;

wherein the first support is connected to the rotating shaft by a support base, wherein the support base is provided with a base height in the axial direction, wherein the base height is at least the double amount of the radial width of the first support; and wherein in an axial cross-section, the first support is provided with a radial width and an axial height and the axial height is at least the double amount of the radial width.

2. Rotating anode assembly according to claim 1, wherein the first support surface is provided on the rotating shaft; and wherein the first axial support surface compensates for thermal expansion of the anode disk such that, during the thermal expansion, a first contact area of the first support surface and a second contact area of the anode disk commonly move in relation to the rotating axis such that the contact is maintained.

3. Rotating anode assembly according to claim 1, wherein the first support is provided protruding in an axial direction from a shoulder on the rotating shaft;

wherein at least a circumferential radial gap to a shaft-end extending through the bore of the anode disk is provided.

4. Rotating anode assembly according to claim 3, wherein the shoulder is formed by a stepweise recess of the outer diameter of the rotating shaft.

5. Rotating anode assembly according to claim 1, wherein the first support is provided with a distance to a shaft-end extending through the bore of the anode disk, wherein the distance is larger than the axial height.

6. Rotating anode assembly according to claim 1, wherein the first support comprises an axial circular collar protruding from the shoulder on the rotating shaft in an axial direction with a clearance groove between the collar and the rotating shaft.

7. Rotating anode assembly according to claim 1, wherein the first support comprises a plurality of radially flexible support elements that provide a plurality of first axial support surface portions.

8. Rotating anode assembly according to claim 7, wherein a heat transfer element is provided between the radially flexible support and the rotating shaft for heat conduction via the rotating shaft.

9. Rotating anode assembly according to claim 8, wherein the second support comprises a second circular axial support surface;

wherein the second support is provided as a radially flexible support; and wherein, upon heating up of the anode disk during X-ray generation, and a thermal expansion of the anode disk, the radially flexible support of the second support bends radially such that the second axial support surface at least partly follows the thermal expansion in a radial direction.

10. An X-ray tube, comprising:

an X-ray vacuum housing;

an anode;

a cathode; and a bearing arrangement for supporting the anode;

wherein the anode and the cathode are arranged inside the X-ray vacuum housing;

wherein the anode is provided as a rotating anode assembly claim 1;

wherein the bearing arrangement is arranged inside the X-ray vacuum housing supporting the rotating shaft; and wherein the bearing arrangement comprises at least one spiral groove bearing.

11. X-ray tube according to claim 10, wherein the rotating shaft is provided hollow with a bore;

wherein a fixed shaft is provided inside the bore supporting the rotating shaft; and wherein the rotating shaft is supported by the fixed shaft with at least one spiral groove bearing.

12. An X-ray imaging system, comprising:

an X-ray acquisition device with an X-ray source and an X-ray detector; and an object support;

wherein the object support is arranged between the X-ray source and the X-ray detector for radiating the object with X-rays provided by the X-ray source; and wherein the X-ray source comprises an X-ray tube according to claim 8.

13. A method for mounting a rotating anode disk, comprising the following steps:

a) providing a first support of an anode disk support at a rotating shaft perpendicular to a rotating axis of the shaft; wherein the first support comprises a first axial support surface that is provided at the rotating shaft in a concentric manner around the rotating axis;

b) providing an anode disk;

c) providing a second support of the anode disk support; wherein the second support comprises a second axial support surface; and d) at least temporarily attaching the second support to the rotating shaft for urging the anode disk against the first support in an axial clamping direction;

wherein the first support is provided as a radially flexible support; and wherein, upon heating up of the anode disk during X-ray generation, the radially flexible support bends radially such that the first axial support surface at least partly follows a thermal expansion of the anode disk in a radial direction wherein the first support has a larger resistance to forces in the axial direction than in the radial direction;

wherein the first support is connected to the rotating shaft by a support base, wherein the support base is provided with a base height in the axial direction, wherein the base height is at least the double amount of the radial width of the first support; and wherein in an axial cross-section, the first support is provided with a radial width and an axial height and the axial height is at least the double amount of the radial width.

14. Use of a support in an X-ray tube for mounting an anode disk to a rotating shaft;

wherein the support comprises a first support with a first axial support surface that is provided at a rotating shaft in a concentric manner around a rotating axis;

wherein a second support with a second axial support surface is provided; the second support being at least temporarily attached to the rotating shaft for urging an anode disk against the first support in an axial clamping direction;

wherein the first support is provided as a radially flexible support; and wherein, upon heating up of the anode disk during X-ray generation, the radially flexible support bends radially such that the first axial support surface at least partly follows a thermal expansion of the anode disk in a radial direction, wherein the first support has a larger resistance to forces in the axial direction than in the radial direction;

wherein the first support is connected to the rotating shaft by a support base, wherein the support base is provided with a base height in the axial direction, wherein the base height is at least the double amount of the radial width of the first support; and wherein in an axial cross-section, the first support is provided with a radial width and an axial height and the axial height is at least the double amount of the radial width.

* * * * *